US007752684B1

(12) United States Patent
Pieretti

(10) Patent No.: US 7,752,684 B1
(45) Date of Patent: Jul. 13, 2010

(54) COMBINATION-CLEANING TOOL AND PLUNGER

(76) Inventor: George Pieretti, 16 Pearl Crest Ct., Pearl River, NY (US) 10965

( * ) Notice: Subject to any disclaimer, the term of this patent is extended or adjusted under 35 U.S.C. 154(b) by 964 days.

(21) Appl. No.: 11/534,481

(22) Filed: Sep. 22, 2006

Related U.S. Application Data

(60) Provisional application No. 60/720,308, filed on Sep. 23, 2005.

(51) Int. Cl.
*E03D 11/00* (2006.01)

(52) U.S. Cl. ..... 4/255.11; 4/255.01; 15/105

(58) Field of Classification Search ..... 4/255.01, 4/255.05, 255.11; 15/104.05, 104.16, 105
See application file for complete search history.

(56) References Cited

U.S. PATENT DOCUMENTS 5,617,605 A 4/1997 Hoerner et al.
5,640,722 A 6/1997 Bui
5,971,141 A 10/1999 Shafik
6,804,839 B1 10/2004 McMaster
7,299,519 B1 * 11/2007 Garry ..... 15/104.05
7,308,728 B2 * 12/2007 Haviv ..... 15/105
2005/0125922 A1 6/2005 Szarawarski

* cited by examiner

*Primary Examiner*—Huyen Le
(74) *Attorney, Agent, or Firm*—William Keyworth; Bill & Mary Lou Inc.

(57) ABSTRACT

A combination cleaning tool and plunger integrates a cleaning tool and plunger in a single shafted tool to save storage space and provide the tools required for non-invasive plumbing maintenance in one convenient tool assembly. The plunger portion of the tool may be attached in a position near the lower end of the shaft for use in plunging a drain, or slidably moved to be attached in a position near the shaft handle at the upper end of the shaft, exposing the cleaning tool at the lower end of the shaft for use. No disassembly of parts or handling of the working parts is required to use either tool.

10 Claims, 9 Drawing Sheets

COMBINATION-CLEANING TOOL AND PLUNGER

CROSS-REFERENCE TO RELATED APPLICATIONS

This application claims the benefit of priority from Provisional Patent Application No. 60/720,308 "Combination Cleaning Tool and Plunger" filed Sep. 23, 2005, which is incorporated herein by reference in its entirety.

STATEMENT REGARDING FEDERALLY SPONSORED RESEARCH AND DEVELOPMENT

Not Applicable.

REFERENCE TO A MICROFICHE APPENDIX

Not Applicable.

BACKGROUND OF THE INVENTION

1. Field of the Invention

This invention relates to a dual-use tool for plumbing maintenance in which a cleaning tool and plunger are operably contained in a single shafted tool. The cleaning tool is used to remove unwanted deposits from the surface of a plumbing fixture. The plunger is used to apply pressure to the drain of a plumbing fixture in order to force a collection of debris down the drain that is preventing free flow through the drain.

2. Description of Related Art

A combination toilet brush/plunger apparatus is disclosed in U.S. Pat. No. 6,804,839 (McMaster). This combination tool provides a bell-shaped plunger attached to the lower portion of a housing. An upper portion of the housing contains a brush protective guard cylinder with a seal to prevent water ingress to the brush chamber, also located in the upper portion of the housing. The brush is attached to the tool handle and bolted to the housing so the brush handle may be used to operate the plunger. In order to use the brush, the user reaches inside the plunger internal cavity and removes the brush protective guard cylinder and seal. The bolt nuts, which attach the brush to the housing, are then removed from the bolts and the brush and handle may then be removed through the opening of the plunger. The reverse order is required to reattach the brush so as to use the plunger. This is a long and tedious procedure that requires the use of hand tools. This defeats the purpose of a dual-purpose tool by making it very tedious to convert from one use to the other. Also, to many users the act of having to reach inside a potentially contaminated plunger cavity to remove a cylinder and seal is repugnant. Another disadvantage is the device also is prone to loss or damage to the cylinder and seal, which are loose parts when the brush is in use.

Another invention claiming to be a combination toilet brush/plunger apparatus is disclosed in US patent application US2005/0125922 (Szarawarski). This combination provides a resilient sponge diaphragm imbedded in a brush assembly. The application claims the sponge diaphragm operates as a toilet plunger. The present applicant's evaluation indicates such a device provides at best a weak plunging action compared to the force available from the conventional bell-shaped resilient plunger, and thus only useful on minor flow impediments. In addition, the use of such a device as a plunger with brush bristles in sewage-contaminated water appears to pose a significant contamination hazard to the user.

SUMMARY OF THE INVENTION

This invention is a combination-cleaning tool and plunger on a single shaft comprising the shaft, a cleaning tool, a plunger seal, a plunger, a plunger handle and a main handle. The shaft has an upper end and a lower end. The upper end is arranged with a main handle attachment adjacent to an upper plunger handle attachment and the lower end is arranged with a lower plunger handle attachment adjacent to a cleaning tool and plunger seal attachment.

The cleaning tool has a body with a cleaning surface, examples are brush bristles or looped fabric strips, and a body attachment arranged to connect to the shaft cleaning tool and plunger seal attachment.

The plunger seal is disk-shaped with a central attachment opening and fits around the shaft between the shaft cleaning tool body attachment and the shaft cleaning tool and plunger seal attachment.

The plunger has an upper end and a lower end. The upper end has an elastic attachment opening containing an elastic attachment and the lower end has an opening mouth providing a lower end of an internal cavity. The internal cavity upper end connects to the elastic attachment opening and provides a seating surface for the plunger seal to close the elastic attachment opening to the internal cavity contents when using the plunger. The plunger opening mouth is arranged to allow entry of the cleaning tool into the plunger internal cavity.

The plunger handle has an upper end, a lower end, an external surface, and a through-hole connecting the upper and lower ends. The through-hole is larger than the shaft outer surface so the plunger handle is movable on the shaft between the shaft upper plunger handle attachment and the lower plunger handle attachment. This provides the means for moving the plunger between the handle and the cleaning tool. The plunger handle upper end through-hole has a shaft connection end attachment to allow the plunger handle to removably connect to the shaft upper plunger handle attachment. This provides the means for removably connecting the plunger to the shaft adjacent to the handle. The plunger handle lower end external surface has an adjacent elastic attachment mate to allow the plunger handle to connect to the plunger elastic attachment. The plunger handle lower end through-hole also has a plunger connection end attachment so the plunger handle removably connects to the shaft lower plunger handle attachment. This connection places the plunger seal in contact with the plunger elastic attachment opening at the plunger cavity upper end, sealing the opening. This also provides the means for removably connecting the plunger to surround the cleaning tool, as the cleaning tool is located within the plunger internal cavity when the plunger is in this position.

The plunger elastic attachment is connected to the plunger handle elastic attachment mate. Then the plunger handle, when connected to the shaft upper plunger handle attachment, retains the plunger near the main handle, which exposes the cleaning tool for use. Also when the plunger handle is connected to the shaft lower plunger handle attachment it places the plunger in position for use.

The main handle has an upper end and a lower end, the lower end arranged with an attachment opening to attach to the shaft.

The assembled handle and plunger is grasped by the plunger handle and removably attached to the shaft upper plunger handle attachment adjacent to the main handle so the cleaning tool is exposed and may be used for cleaning purposes. Then the assembled handle and plunger is grasped by the plunger handle, detached from the shaft upper plunger handle attachment adjacent to the main handle, and removably attached to the shaft lower plunger handle attachment adjacent to the shaft second end, such that the cleaning tool is contained within the plunger cavity, thus allowing the plunger to be used as a drain blockage removal tool.

OBJECTS AND ADVANTAGES

An object of this invention is to provide a compact tool that minimizes storage space required.

A second object of this invention is to provide the tools required for non-invasive plumbing maintenance in one convenient tool assembly.

A third object of this invention is to provide a combination-cleaning tool and plunger that is converted from one tool to the other without the user being required to contact the potentially contaminated working surfaces of the cleaning tool or the plunger.

BRIEF DESCRIPTION OF THE SEVERAL VIEWS OF THE DRAWINGS

A more complete understanding of the present invention can be obtained by considering the detailed description in conjunction with the accompanying drawings, in which.

REFERENCE NUMERALS IN DRAWINGS

Figure 1:
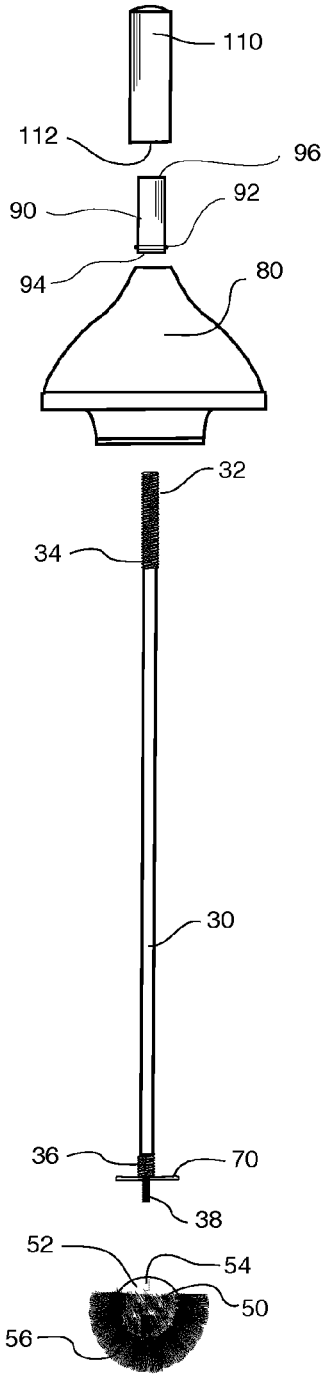
FIG. 1 is a side view of a disassembled combination-cleaning tool and plunger showing the component parts.

These reference numbers are used in the drawings to refer to areas or features of the invention.

30 Shaft
32 Shaft Main Handle Attachment
34 Shaft Upper Plunger Handle Attachment
36 Shaft Lower Plunger Handle Attachment
38 Shaft Cleaning Tool and Plunger Seal Attachment
40 Shaft Upper Bayonet Attachment
50 Cleaning Tool
52 Cleaning Tool Body
54 Cleaning Tool Body Attachment
56 Cleaning Tool Cleaning Surface
70 Plunger Seal
72 Plunger Seal Attachment Opening
74 Plunger Handle Bayonet Attachment
76 Plunger Handle Bayonet Guide Pin
77 Plunger Seal Brush Body Seal
80 Plunger
82 Plunger Elastic Attachment Opening
84 Plunger Elastic Attachment
86 Plunger Internal Cavity
88 Plunger Opening Mouth
90 Plunger Handle
92 Plunger Handle Elastic Attachment Mate
94 Plunger Handle Plunger Connection End Attachment
96 Plunger Handle Shaft Connection End Attachment
98 Plunger Handle Plunger Connection End Shaft Bayonet Attachment
99 Plunger Handle Through-Hole
100 Plunger Handle Shaft Connection End Shaft Bayonet Attachment
102 Plunger Handle Bayonet Guide Pin
110 Main Handle
112 Main Handle Attachment Opening

DETAILED DESCRIPTION OF THE INVENTION

The combination cleaning tool and plunger provides for cleaning plumbing fixtures, and clearing drain blockage in one compact tool. The tool provides these multiple functions by arranging the cleaning tool at the end of a shaft, and arranging the plunger slidably on the shaft, with attachments near each end of the shaft so it may be attached to the shaft in a lower position, surrounding the cleaning tool, for plunger use, or the plunger may be slid upwards and attached to the shaft in an upper position, near the handle and remote from the cleaning tool, for cleaning tool use.

FIG. 1 shows a disassembled combination cleaning tool and plunger. The tool comprises the main handle (110), the shaft (30), the cleaning tool (50), the plunger seal (70), the plunger (80) and the plunger handle (90). Each of these parts and their assembly to allow use of the tool as a combination cleaning tool and plunger is described in detail in the following.

Figure 2:
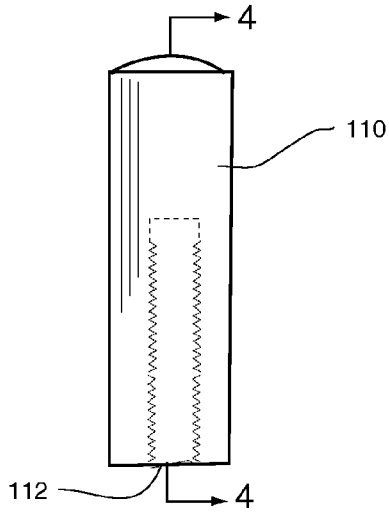
FIG. 2 is a side view of the main handle. This view shows the location on the handle for the cut-away view in FIG. 4.
Figure 3:
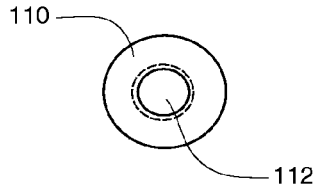
FIG. 3 is a bottom view of the main handle.
Figure 4:
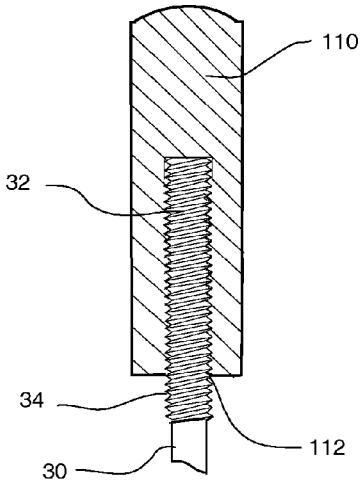
FIG. 4 is a cut-away view of the main handle assembled on the shaft.

FIG. 2 shows a side view of the main handle (110) with a threaded internal main handle attachment opening (112) shown in dotted lines. FIG. 3 shows a bottom view of the main handle (110) with the threaded main handle attachment opening (112) shown extending into the handle from the bottom. FIG. 4 shows a cut-away view of the main handle (110) and shaft (30) assembled. The cut-away is at the location shown in FIG. 2. The shaft (30) has a main handle attachment (32), and an upper plunger attachment (34) formed by screw threads on the upper first end of the main shaft (30). The threads are longer than the main handle attachment opening (112) to form the main handle attachment (32) and the upper plunger attachment (34). The main handle may be constructed of plastic, wood-based materials, metal, real or synthetic stone, ceramic, or covered with materials pleasing to the décor and touch of the user.

Figure 5:
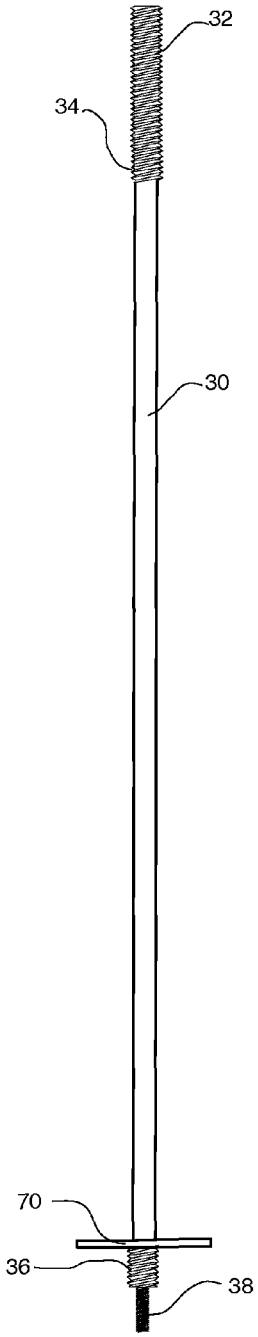
FIG. 5 is a side view of the shaft.
Figure 6:
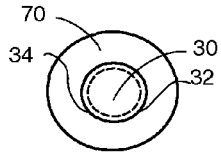
FIG. 6 is a top view of the shaft.
Figure 7:
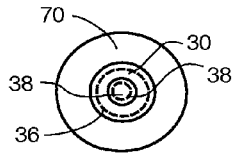
FIG. 7 is a bottom view of the shaft.

A side view of the shaft (30) is shown in FIG. 5. FIG. 6 shows a top view of the shaft (30) and FIG. 7 shows a bottom view of the shaft (30). FIG. 5 illustrates the position of the main handle attachment (32), and the upper plunger attachment (36) near the upper end of the shaft (30). The opposite end of the shaft (30), the second end, has a lower plunger handle attachment (36) and cleaning tool and shaft plunger seal attachment (38), both comprising screw threads. FIG. 6 shows a top view of the shaft (30) and FIG. 7 shows a bottom view of the shaft (30). The connections described previous are shown in dotted lines. The shaft (30) may be constructed of plastic, wood-based materials, metal, real or synthetic stone, ceramic as long as the material provides a diameter consistent with sliding the plunger and plunger handle between the upper and lower plunger handle attachments (34 and 36).

Figure 8:
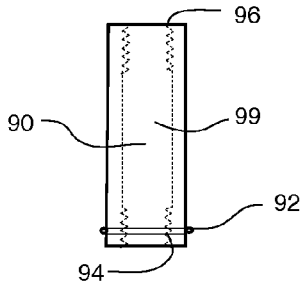
FIG. 8 is a side view of the plunger handle.
Figure 9:
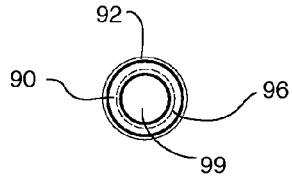
FIG. 9 is a top view of the plunger handle.
Figure 10:
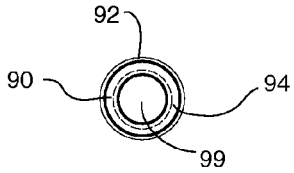
FIG. 10 is a bottom view of the plunger handle.

The plunger handle (90) side view is shown in FIG. 8 and the top and bottom view, respectively, is shown in FIG. 9 and FIG. 10. The plunger handle (90) is substantially cylindrical in shape with the outside surface of the cylinder having a ridge called the elastic attachment mate (92). This elastic attachment mate (92) is arranged to secure the plunger handle (90) to the plunger as described in detail in the description of the plunger, which follows below. The plunger handle (90) has a through hole (99) providing an inner surface arranged with an upper shaft connection end attachment (96) and a lower plunger connection end attachment (94) comprising common screw threads. The plunger handle (90) may be constructed of plastic, wood-based materials, metal, real or synthetic stone, ceramic, or other material which provides a smooth external surface for attachment to the plunger and a consistent internal diameter arranged to allow the plunger handle (90) to slide on the shaft (30) between the shaft upper and lower plunger handle attachments (34 and 36).

Figure 11:
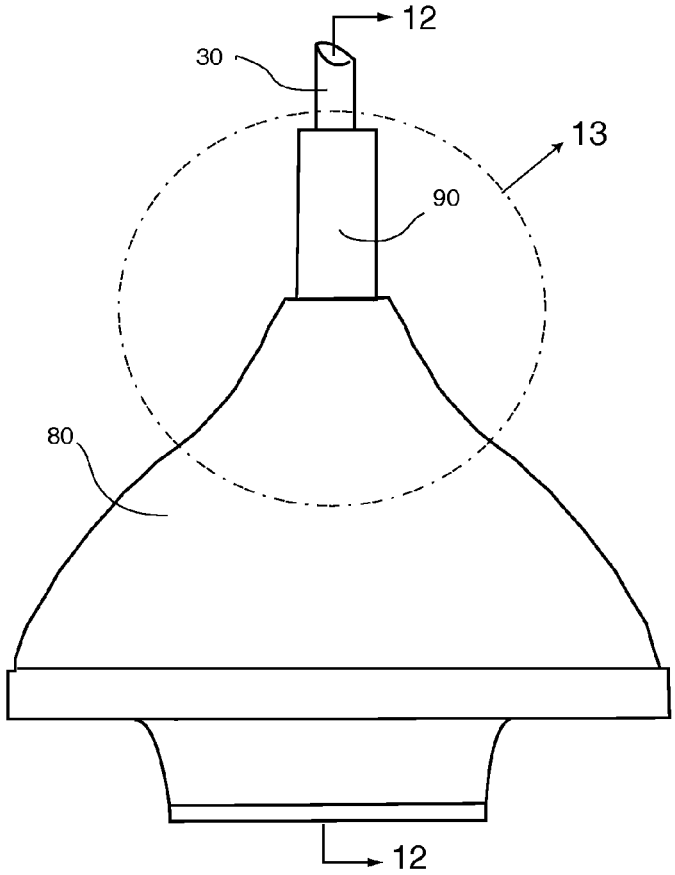
FIG. 11 is a side view of the assembled plunger, plunger handle, and shaft with the plunger handle attached to the shaft lower plunger handle attachment to retain the plunger in the lower position. This view shows the location of the cut-away view in FIG. 12 and the expanded view in FIG. 13.

The assembled plunger (80), plunger handle (90) and shaft (30) are shown in FIG. 11. In this view the plunger handle plunger connection end attachment (94), as shown in FIGS. 8, 9, and 10 is attached to the shaft lower plunger handle attachment (36) as shown in FIGS. 1, 4 and 5.

Figure 12:
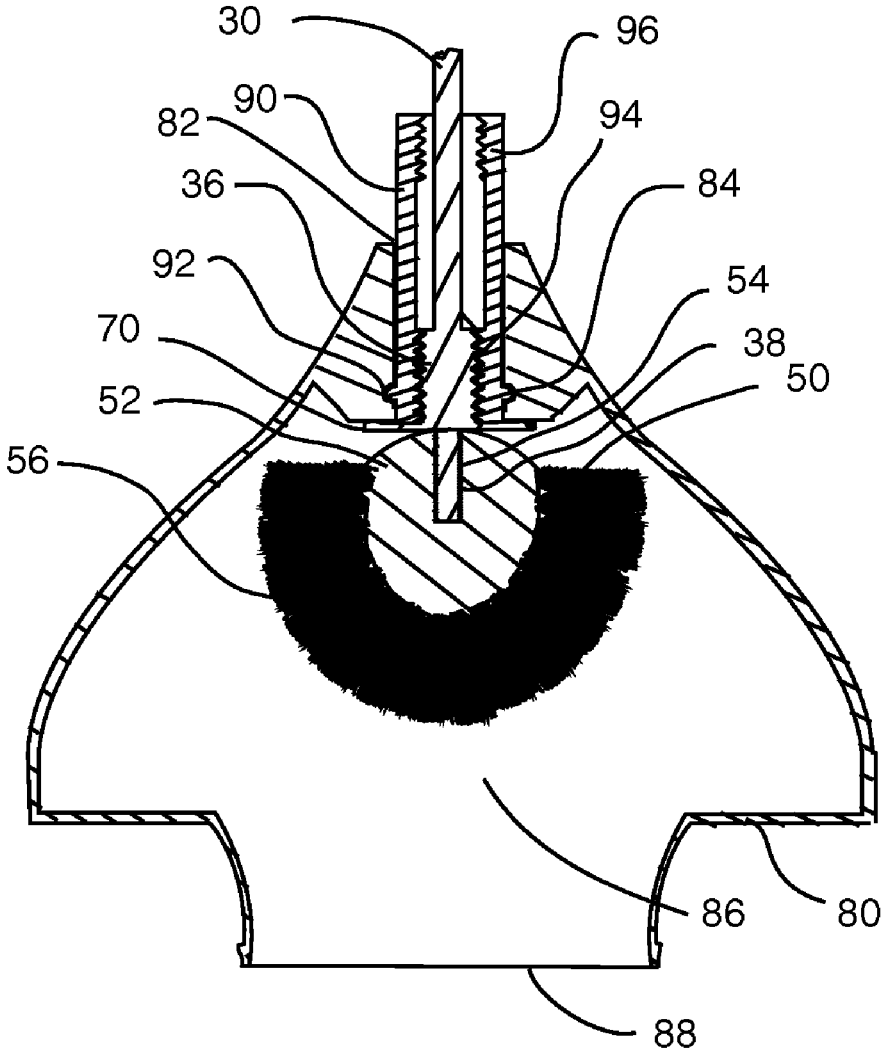
FIG. 12 is a cut-away side view of the assembled plunger, plunger handle, plunger seal, cleaning tool, and shaft with the plunger handle attached to the shaft lower plunger handle attachment to retain the plunger in the lower position.
Figure 13:
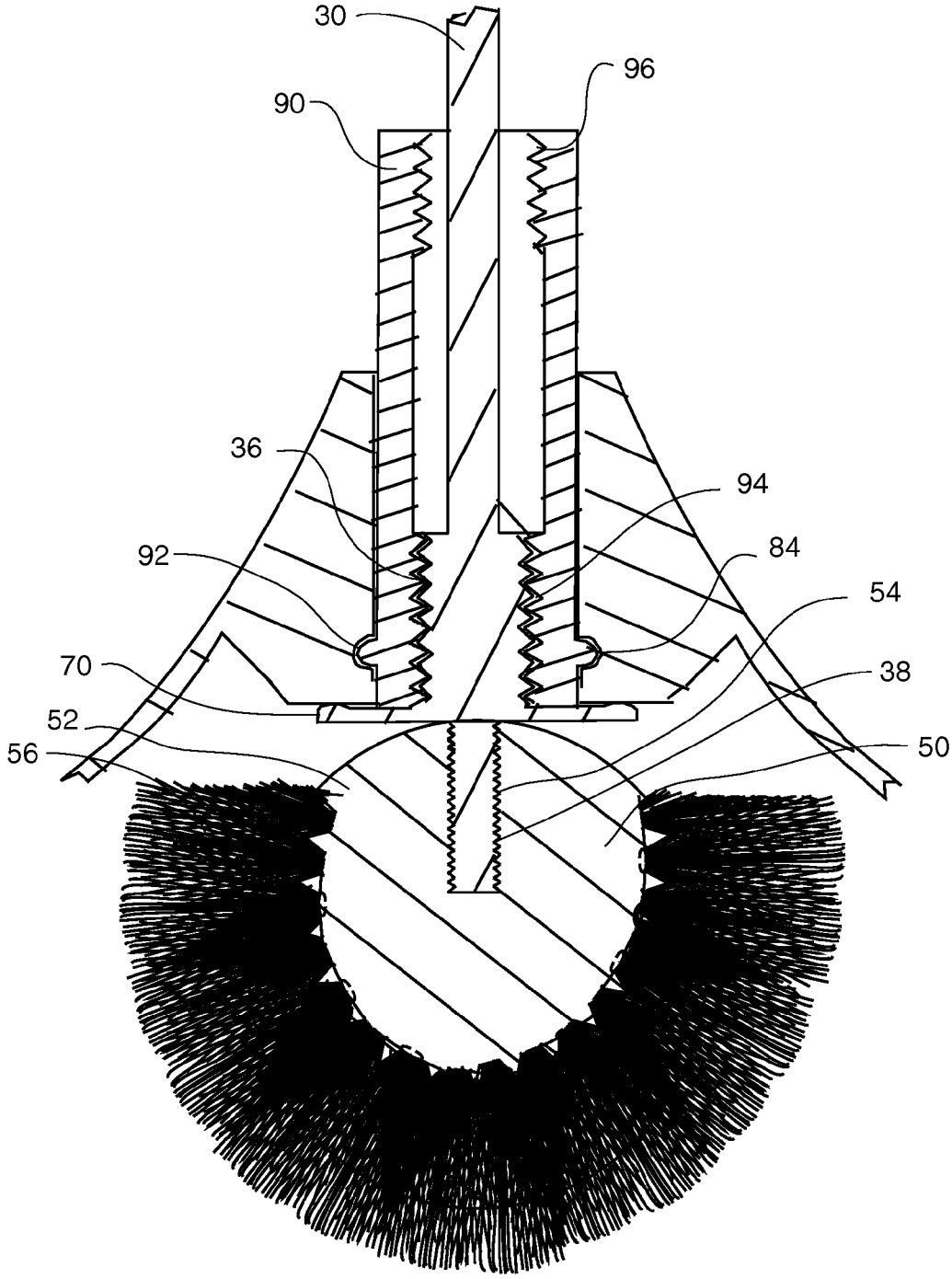
FIG. 13 is an expanded cut-away view of the assembled plunger, plunger handle, plunger seal, cleaning tool, and shaft as shown in FIG. 12.

A cut-away view of the assembly of FIG. 11 is shown in FIG. 12 at the location indicated in FIG. 11. The cleaning tool (50) has a body (52) with an attachment (54) that screws on the shaft cleaning tool and shaft plunger seal attachment (38). An expanded view of the cut-away location shown by the broken line circle in FIG. 11 is shown in FIG. 13 to better show the details. The cleaning tool cleaning surface (56) is made up of a multitude of bristles that form a brush, or looped fabric that form a small mop, or other cleaning materials suitable for a wet environment. The cleaning tool body (52) is preferably of a material (example plastic) that is non-corrosive in a wet environment.

FIGS. 12 and 13 show the positioning of the plunger seal (70) on the shaft (30) is arranged so the plunger seal may engage the plunger (80) at the plunger elastic attachment (84) lower opening. This seals the openings at the attachment to the plunger handle (90) and the attachment of the plunger handle to the shaft (30) during plunger use to prevent water leakage between the plunger handle (90) and shaft (30) that could pose a contamination hazard to the user.

The plunger handle (90) is assembled on the plunger (80) by pressing the handle (90) into the plunger elastic attachment opening (82) until the plunger handle elastic attachment mate (92) engages the plunger elastic attachment (84). The plunger is made of an elastic material (example rubber). Such materials are well known in the art. This assembly, consisting of the plunger (80) and plunger handle (90) is shown in FIGS. 12 and 13 with the plunger handle plunger connection end attachment (94) attached to the shaft lower plunger handle attachment (36). This attachment of the plunger (80) and plunger handle (90) to the shaft lower plunger handle attachment (36) places the cleaning tool (50) within the plunger internal cavity (86) and also brings the plunger seal (70) into contact with the plunger elastic attachment (84) lower opening. In this position the tool is ready for use of the plunger.

Figure 14:
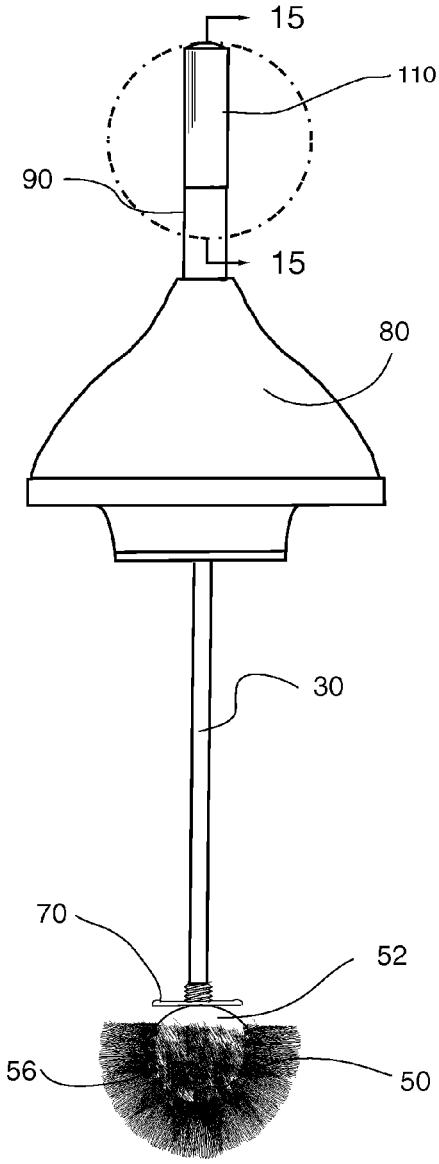
FIG. 14 is a side view of the assembled combination cleaning tool and plunger with the plunger handle attached to the shaft upper plunger handle attachment to retain the plunger in the upper position. This view shows the location of the cut-away view in FIG. 15.
Figure 15:
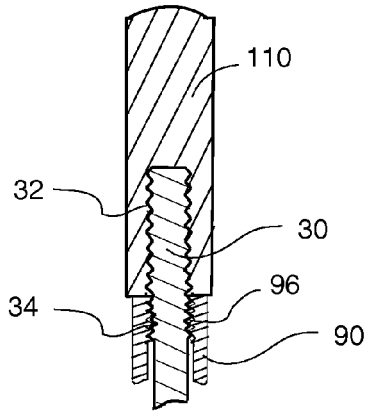
FIG. 15 is a cut-away side view of the assembled main handle, shaft, and plunger handle with the plunger handle attached to the shaft upper plunger handle attachment to retain the plunger in the upper position.

The plunger (80) and plunger handle (90) is shown in FIGS. 14 and 15 with the plunger handle shaft connection end shaft attachment (96) attached to the shaft upper plunger handle attachment (34). In FIG. 14 the shaft upper plunger handle attachment is hidden by the plunger handle. FIG. 15 shows a cut-away view of this connection at the location indicated in FIG. 14. This attachment of the plunger (80) and plunger handle (90) to the shaft upper plunger handle attachment (34) is accomplished by disengaging the plunger (80) and plunger handle (90) assembly from the shaft lower plunger handle attachment (36), sliding the plunger and plunger handle assembly up the shaft and engaging the shaft upper plunger handle attachment (34) with the plunger handle shaft connection end attachment (96). With the plunger and plunger handle assembly moved to this upper position the cleaning tool is exposed for use as shown in FIG. 14.

Alternate Embodiments

Figure 16:
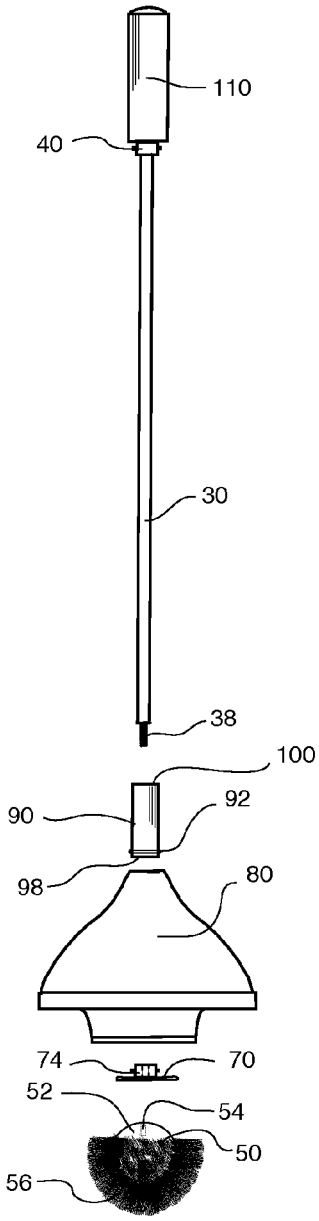
FIG. 16 is a side view of a disassembled combination-cleaning tool and plunger showing an embodiment using a two-pin bayonet for the shaft upper and lower plunger handle attachment.
Figure 17:
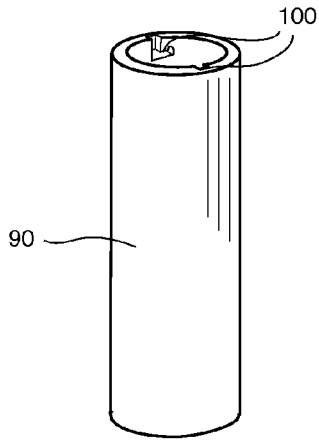
FIG. 17 is a perspective view of the plunger handle in an embodiment using a two-pin bayonet for the shaft connection end and plunger connection end attachment, showing the shaft connection end female bayonet connection.

Another embodiment of the combination cleaning tool and plunger is shown in FIGS. 16 and 17. In this embodiment fastening is accomplished by a two-pin bayonet attachment. Other bayonet attachment arrangements well known to those familiar with the art may also be used. The shaft upper plunger handle attachment (34) in this embodiment is a round male bayonet (40) arranged with two pins on opposing sides. The male bayonet attachment slides into a female bayonet, shown in FIG. 17, with the pins entering the bayonet grooves (100). When fully inserted, the female bayonet allows rotary motion in a clockwise direction to complete the attachment.

The lower plunger handle bayonet attachment (74) is arranged as a male two-pin bayonet attachment adjacent to, or part of, a plunger seal (70), separate from the shaft (30). This part, or parts, attach to the shaft (30) with the attachment of the cleaning tool (50) that is previously described. The engagement of the plunger handle plunger connection end bayonet attachment (98) to the lower plunger handle bayonet attachment (74) is similar to the upper attachment. In the embodiment shown, the main handle (110) may be formed continuous with the shaft (30), or made separate and joined to the shaft (30) by connection means, or by adhesive, or by a welding technique.

Figure 18:
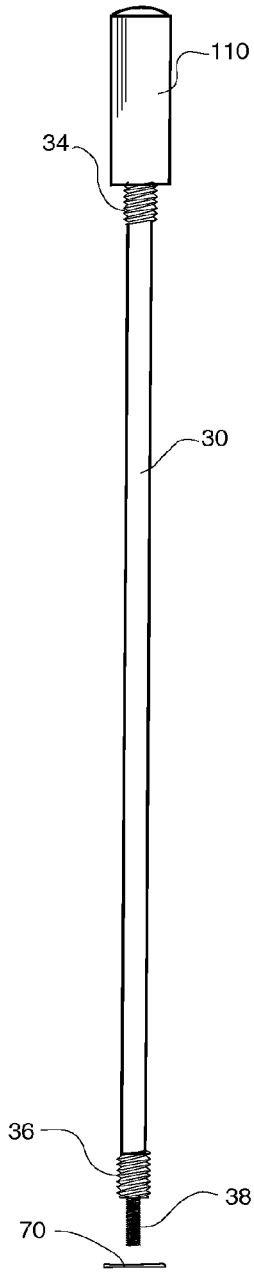
FIG. 18 is a side view of an embodiment of the shaft with an integral main handle. The figure also shows the separate plunger seal used in this embodiment.

Another equivalent embodiment of the combination cleaning tool and plunger using threaded attachments is shown in FIG. 18. The shaft (30) in this embodiment has a separate plunger seal (70) rather than an integral one, so the main handle (110) may be formed continuous with the shaft (30), or made separate and joined to the shaft (30) by connection means, or by adhesive, or by a welding technique.

Figure 19:
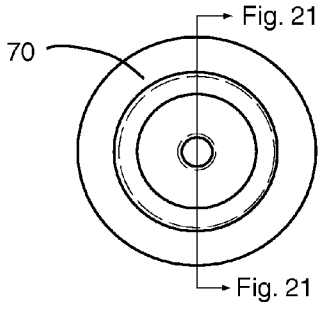
FIG. 19 is a bottom view of a separate plunger seal consisting of two part, the plunger seal and a brush body seal. The location of the cross-section of FIG. 21 is also shown.
Figure 20:
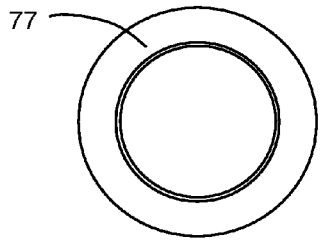
FIG. 20 is a top view of the two-piece plunger seal brush body seal.
Figure 21:
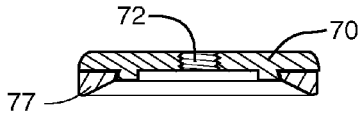
FIG. 21 is a central cross-section of the two-piece plunger seal assembled. The location of the cross-section is shown in FIG. 19.

An embodiment of the combination cleaning tool and plunger seal (70) using a brush body seal (77) is shown in FIGS. 19, 20 and 21. FIG. 19 shows a bottom view of the plunger seal (70). FIG. 20 shows a bottom view of the brush body seal (77), which is made of a resilient material such as rubber. The brush body seal (77) is connected to the plunger seal by stretching the resilient material around the raised surface on the bottom of the plunger seal (70). This connection is shown in the cross-section shown in FIG. 21.

Figure 22:
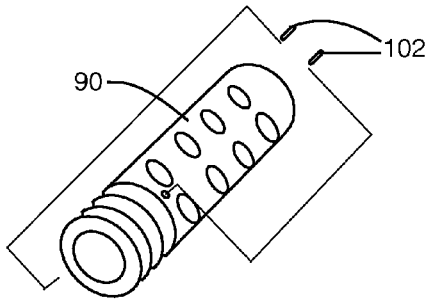
FIG. 22 is a perspective view of an embodiment of the plunger handle with a double elastic attachment mate using pins to guide the plunger handle in a bayonet slot in the shaft.
Figure 23:
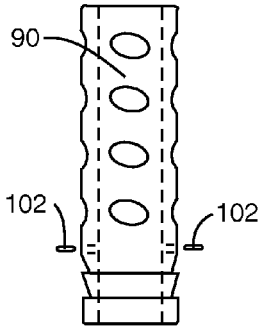
FIG. 23 is a side view of the embodiment of the plunger handle with a double elastic attachment mate and using pins to guide the plunger handle in a bayonet slots in the shaft.
Figure 24:
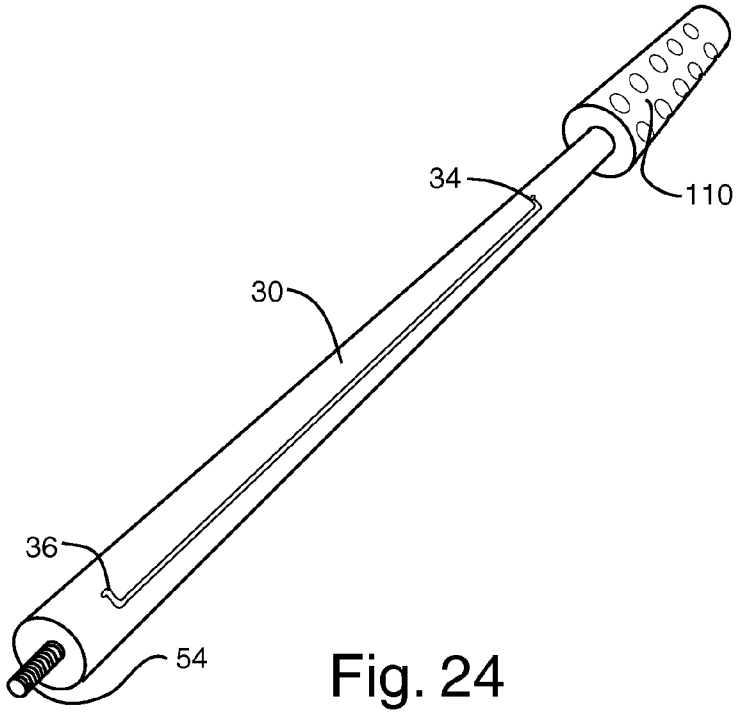
FIG. 24 is a perspective view of an embodiment of the shaft with bayonet slots in the shaft.
Figure 25:
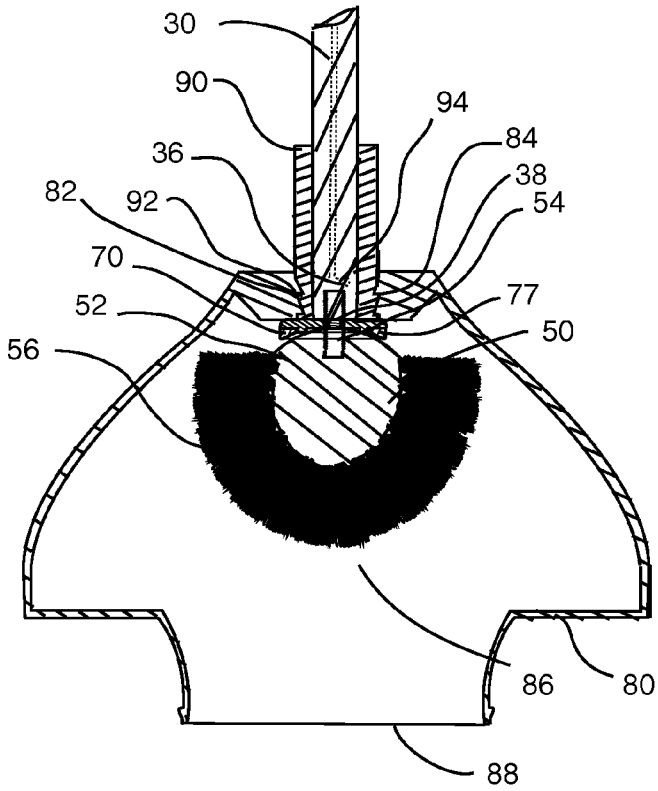
FIG. 25 is a cut-away side view of the shaft embodiment shown in FIG. 24 with an assembled plunger, plunger handle, plunger seal, cleaning tool, and shaft with the plunger handle attached to the shaft lower plunger handle attachment to retain the plunger in the lower position.

An embodiment of the combination cleaning tool and plunger using a two-pin bayonet is shown in FIGS. 22, 23, 24 and 25. FIGS. 22 and 23 show an embodiment of the plunger handle (90) with multiple elastic attachment mates (92). This embodiment also has openings for bayonet guide pins (102). The pins are spring pins or sized for a force fit in the handle openings. FIG. 24 shows the shaft (30) used with this embodiment. It contains two axially oriented bayonet slots on opposing sides of the shaft with the bayonet shaft upper plunger handle attachment (34) at the upper end of the slots and the shaft lower plunger handle attachment (36) at the lower end of the slots. The engagement of this embodiment of the plunger handle (90) with the plunger (80) and the shaft lower plunger handle attachment (36) is shown in FIG. 25. This figure also shows the use of the plunger seal (70) with a brush body seal (77).

Those skilled in the art will recognize the combination cleaning tool and plunger may be made with a variety of construction details changed, depending on materials chosen, or on the attachment type, or combinations of attachment types chosen. It is intended this invention is not limited by the exact construction shown and described, but that suitable modifications and equivalents are also encompassed by this invention. It is intended that the preferred and other embodiments of the present invention cover the modifications and variations of this invention provided they come within the scope of the appended claims and their equivalents.

Operation

The combination cleaning tool and plunger, as shown in FIGS. 1 through 15, is assembled by attaching the plunger handle (90) to the plunger (80) as previously described. The plunger (80) and plunger handle (90) are then positioned on the shaft (30) by threading the plunger handle shaft connection ends past the shaft upper plunger handle attachment (34) so the plunger handle (90) and plunger (80) may slide on the shaft between the upper and lower plunger handle connections (34 and 36). The handle (110) is then attached to the shaft (30). The plunger (80) and plunger handle (90) are then positioned on the shaft (30) upper plunger handle attachment (34). This positioning allows the cleaning tool (50) to be attached to the shaft cleaning tool and plunger seal attachment (38) by the cleaning tool body attachment (54). The combination cleaning tool and plunger is now assembled as shown in FIG. 14.

The embodiment shown in FIGS. 16 and 17 is assembled in a similar manner. The plunger (80) and plunger handle (90) assembly is positioned on the shaft (30) without threading, but simply by sliding them on the shaft (30) second end, which does not have an integral plunger seal in these embodiments. The lower plunger handle attachment (74) and the plunger seal (70) are attached to the shaft by attaching the cleaning tool (50) as described previously.

The embodiment shown in FIG. 18 is also assembled in a similar manner. The plunger (80) and plunger handle (90) assembly is positioned on the shaft (30) by threading them on the shaft (30) second end, which does not have an integral plunger seal in this embodiment. The lower plunger handle attachment (74) and the plunger seal (70) are attached to the shaft by attaching the cleaning tool (50) as described previously.

The embodiment shown in FIGS. 23 through 25 is assembled by sliding the plunger handle (90) on the shaft (30) and then installing the bayonet guide pins (102) in the openings in the plunger handle (90). The pins are installed a sufficient distance so the ends of the pins are inserted in the slot in the handle connecting the upper plunger handle attachment (34) and the lower plunger handle attachment (36). The plunger handle (90) then is captured on the shaft, but free to be rotated in or out of the upper plunger handle attachment (34) and the lower plunger handle attachment (36) and then along the shaft to the opposite attachment.

Once assembled, the combination cleaning tool and plunger may be used as a cleaning tool with the plunger (80) and plunger handle (90) fastened to the upper plunger handle attachment (34) or in an alternate embodiment to the upper bayonet attachment (40). This lifts the plunger (80) above the cleaning tool (50). The tool may then be grasped by the handle and the cleaning tool (50) used to clean the plumbing fixture. Alternately, the combination cleaning tool and plunger may be used as a plunger with the plunger (80) and plunger handle (90) fastened to the lower plunger handle attachment (36) or an alternate embodiment to the lower plunger handle bayonet attachment (74). This places the cleaning tool (50) inside the plunger internal cavity (86). The tool may then be grasped by the handle and the plunger opening mouth (88) applied to the plumbing fixture drain opening. The tool is then vigorously moved in an up and down motion to apply hydraulic force from the plunger opening mouth (88) to the drain opening to clear the blockage.

Changing between the use of the cleaning tool and the use of the plunger is accomplished by holding the shaft (30) by the handle (110) and grasping the plunger handle (90) to disengage the plunger handle from the shaft upper plunger handle attachment (34). The plunger handle is slide down the shaft until the plunger handle can be connected to the shaft lower plunger handle attachment (36). The tool is then configured for use of the plunger.

I claim:

1. A combination cleaning tool and plunger comprising:

a. a shaft, a cleaning tool, a plunger seal, a plunger, a plunger handle and a main handle;

b. the shaft with an upper end and a lower end, the upper end arranged with a main handle attachment adjacent to an upper plunger handle attachment and the lower end arranged with a lower plunger handle attachment adjacent to a cleaning tool and plunger seal attachment, and an outer surface arranged between the upper plunger handle attachment and the lower plunger handle attachment;

c. the cleaning tool with a body arranged with a cleaning surface, and a body attachment arranged connectedly with the shaft cleaning tool and plunger seal attachment;

d. the plunger seal is disk-shaped and arranged on the shaft between the shaft cleaning tool body attachment and the shaft cleaning tool and plunger seal attachment;

e. the plunger with an upper end and a lower end, the upper end with an elastic attachment opening containing an elastic attachment and the lower end with an opening mouth providing a lower end of an internal cavity, and an internal cavity upper end connected to the elastic attachment opening, the plunger opening mouth arranged for entry of the cleaning tool into the plunger internal cavity;

f. the plunger handle with an upper end and a lower end and an external surface and a through-hole connecting the upper and lower ends, the through-hole arranged larger than the shaft outer surface, and the plunger handle is movably arranged on the shaft between the shaft upper plunger handle attachment and the lower plunger handle attachment;

g. the plunger handle upper end through-hole further arranged with a shaft connection end attachment such that the plunger handle removably connects to the shaft upper plunger handle attachment, the plunger handle lower end external surface further arranged with an adjacent elastic attachment mate arranged to removably connects to the plunger elastic attachment, and the plunger handle lower end through-hole further arranged with a plunger connection end attachment such that the plunger handle removably connects to the shaft lower plunger handle attachment and such connection places the plunger seal in contact with the plunger elastic attachment opening at the plunger cavity upper end; and h. the main handle with an upper end and a lower end, the lower end arranged with an attachment opening arranged such that the main handle is attached to the shaft main handle attachment, wherein the plunger attached to the plunger handle removably connects to the shaft upper plunger handle attachment, retaining the plunger adjacent to the main handle and exposing the cleaning tool for use, and wherein the plunger handle removably connects to the shaft lower plunger handle attachment retaining the plunger in position for plunger use.

2. The combination cleaning tool and plunger as in claim 1 wherein the shaft upper plunger handle attachment and plunger handle shaft connection end attachment are threaded attachments.

3. The combination cleaning tool and plunger as in claim 1 wherein the shaft upper plunger handle attachment and plunger handle shaft connection end attachment are bayonet attachments.

4. The combination cleaning tool and plunger as in claim 1 wherein the shaft lower plunger handle attachment and the plunger handle plunger connection end attachment are threaded attachments.

5. The combination cleaning tool and plunger as in claim 1 wherein the shaft lower plunger handle attachment and the plunger handle plunger connection end attachment are bayonet attachments.

6. The combination cleaning tool and plunger as in claim 1 wherein the plunger seal is disk shaped with a central attachment opening arranged with the shaft inserted into the seal attachment opening.

7. The combination cleaning tool and plunger as in claim 1 wherein the plunger seal is disk shaped with a central attachment opening arranged with the shaft inserted into the seal attachment opening and is connected to a lower plunger handle bayonet attachment.

8. The combination cleaning tool and plunger as in claim 1 further comprising a brush body seal connected to the plunger seal.

9. A combination cleaning tool and plunger comprising:

a. a shaft with an upper end and a lower end;

b. a handle connected to the shaft upper end;

c. a cleaning tool connected to the shaft lower end;

d. a plunger;

e. means for removably connecting the plunger to the shaft adjacent to the handle;

f. means for moving the plunger between the handle and the cleaning tool; and g. means for removably connecting the plunger to surround the cleaning tool, whereby the plunger is connected adjacent to the handle to use the cleaning tool and the plunger is connected to surround the cleaning tool to use the plunger.

10. A method of manufacturing a combination cleaning tool and plunger comprising:

a. forming a shaft with an upper end arranged with a main handle attachment adjacent to an upper plunger handle attachment, and a lower end arranged with a lower plunger handle attachment adjacent to a cleaning tool and plunger seal attachment, and an outer surface arranged between the upper plunger handle attachment and the lower plunger handle attachment;

b. connecting a cleaning tool with a body arranged with a cleaning surface, and a body attachment, to the shaft cleaning tool and plunger seal attachment;

c. providing a disk-shaped plunger seal with a central attachment opening;

d. arranging the plunger seal shaft cleaning tool body attachment and the shaft cleaning tool and plunger seal attachment with the shaft inserted into the seal attachment opening;

e. connecting a plunger to a plunger handle; and f. providing the plunger and handle with means for removably connecting the plunger to the shaft adjacent to the handle, means for moving the plunger between the handle and the cleaning tool, and means for removably connecting the plunger to surround the cleaning tool.

* * * * *